US006647643B2

(12) United States Patent
Song et al.

(10) Patent No.: US 6,647,643 B2
(45) Date of Patent: Nov. 18, 2003

(54) CLOTHES DRYER

(75) Inventors: Sung Bae Song, Seoul (KR); Sang Wook Hong, Seoul (KR); Sang Heon Yoon, Seoul (KR); Hwan Joo Myung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/040,642

(22) Filed: Jan. 9, 2002

(65) Prior Publication Data

US 2003/0000104 A1 Jan. 2, 2003

(30) Foreign Application Priority Data

Jun. 29, 2001 (KR) ..... 10-2001/38255

(51) Int. Cl.[7] ..... F26B 11/02

(52) U.S. Cl. ..... 34/595; 34/605; 34/114; 34/606; 34/607

(58) Field of Search ..... 34/605, 108, 114, 34/115, 595, 603, 604, 606, 607

(56) References Cited

U.S. PATENT DOCUMENTS 1,623,540 A * 4/1927 Hunt ..... 34/82
2,271,757 A * 2/1942 Boltz ..... 34/82
3,116,243 A * 12/1963 Khan et al. ..... 210/78
3,123,700 A * 3/1964 Snyder et al. ..... 219/19
3,177,592 A * 4/1965 Meyer ..... 34/82
3,725,532 A * 4/1973 Fernandes et al. ..... 423/245
4,033,047 A * 7/1977 Kawai ..... 34/82
4,338,730 A * 7/1982 Tatsumi et al. ..... 34/54
4,557,058 A * 12/1985 Ozawa et al. ..... 34/82
4,811,495 A * 3/1989 Huang et al. ..... 34/131
5,771,604 A * 6/1998 Wunderlich et al. ..... 34/603
5,806,204 A * 9/1998 Hoffman et al. ..... 34/92
6,354,017 B1 * 3/2002 Bertoldo ..... 34/115

* cited by examiner

*Primary Examiner*—Ira S. Lazarus
*Assistant Examiner*—K. B. Rinehart
(74) *Attorney, Agent, or Firm*—Birch, Stewart, Kolasch & Birch, LLP

(57) ABSTRACT

A clothes dryer, for drying washed clothes, including a drum supported in a case rotatably, for drying clothes inserted to the inside of the case, a driving means installed in the case, for rotating the drum, a suction duct connected to a side of the drum, for supplying heated air to the inside of the drum, an exhaust duct connected to the other side of the drum, for exhausting air which dried the clothes in the drum, a first blowing means installed in the suction duct or the exhaust duct, for flowing air to the inside of the drum and exhausting the air at the same time and a suction increasing means installed in the case, for blowing air into an inlet of the suction duct can improve clothes drying performance and reduce time for drying clothes by increasing the amount of air supplied into the drum.

17 Claims, 5 Drawing Sheets

CLOTHES DRYER

BACKGROUND OF THE INVENTION

1. Field of the Invention

The present invention relates to a clothes dryer and particularly, to an exhausting-type clothes dryer for drying clothes by circulating air inside a drum after sucking external air using a fan and heating with a heater.

2. Description of the Background Art

Generally, a clothes dryer is an apparatus for automatically drying wet clothes after being washed, being installed apart from a washing machine and is classified into a dehumidifying-type and exhausting-type.

The dehumidifying-type is a method for drying clothes by condensing moisture circulating air in the drum, exhausting water generated at this time to the outside of the dryer and supplying air heated to the inside of a drum.

The exhausting-type is a method for drying clothes by guiding external air of the dryer into the drum after sucking and heating the air and exhausting the air into the outside of the dryer again.

FIG. 1 is a view showing the exhausting-type clothes dryer and the conventional clothes dryer will be described as follows.

With reference to FIG. 1, the conventional clothes dryer includes a case 1 having an input opening 1A on the front surface, a door for opening and closing the input opening 1A of the case 1, a drum 3 installed in the case 1 rotatably, for receiving clothes, having a plurality of baffles 3D protruded on the inner circumferential surface, a driving motor 4 and transmission means 5 installed in the case 1, for rotating the drum, an air circulation unit 7 for exhausting external air of the case 1 into the outside of the case 1 after flowing the air into the drum 3 and a heater 6 installed at the inlet side of the suction duct 7A of the above air circulation unit 7, for heating air flown into the drum.

The drum 3 includes a body 3A which rotates being connected to the driving motor 4 and the transmission means 5 and side plates 3B and 3C combined to the body 3A at the both sides of the body 3A movably.

The body 3A has a cylindrical shape and the above pluralities of baffles 3D are formed on the circumferential surface at the inner side of the body 3A as a single body.

The above side plates 3B and 3C are all formed in a circular plate shape and a suction port 3*b* connected with the suction duct 7A of the air circulation unit 7 is formed on the rear plate 3B and the exhaust port 3*c* connected with an exhaust duct of the air circulation unit 7 which will be described later is formed on the front plate 3C.

The heater 6 is installed at the inlet side of the suction duct 7A being adjacent or combined to the inlet side and conventionally, electric heater and gas heater are used.

The air circulation unit 7 includes the suction duct 7A for guiding air in the case 1 into the drum 3, the exhaust duct 7B for exhausting the air in the drum 3 to the outside of the case 1 and a fan positioned at the center of the exhaust duct 7B, for flowing air.

The suction duct 7A is installed to guide air heated passing the heater 6 after the air is flown to the inside through the air circulation port 1B of the case 1 into the drum 3. The inlet is positioned or combined to the rear of the heater 6 and the outlet is installed to be connected with the suction port 3B of the drum 3.

The exhaust duct 7B has an inlet installed being connected to the suction port 3C of the drum 3 and the outlet is lengthened-installed to the outside penetrating the rear wall of the case 1.

The fan 7C is combined to a driving shaft of another side of the driving motor 4 which is at another side of the transmission means 5 in the exhaust duct 7B and accordingly, is composed of single inlet centrifugal fans having a suction side and an exhaust side respectively.

In FIG. 1, reference numeral 3D designates a clothes input opening of the drum and F designates a filter.

The operation of the conventional clothes dryer with the above composition will be described as follows.

When a power is applied to the driving motor 4, the drum 3 is rotated by the belt 5*b* and clothes in the drum 3 are mixed. After the external air is heated as the fan 7C rotates, the air is supplied into the drum 3 and dries wet clothes.

Namely, when the fan 7C is operated the external air is sucked into the case 1 and the air is heated passing the heater 6 and flown to the inside of the drum 3 through the suction duct 7A and the suction port 3*b*. The heated air flown into the drum dries the wet clothes and then is exhausted to the outside of the case 1 through the exhaust port 3*c* and the exhaust duct 7B.

However, in the conventional clothes dryer, suction is operated by the indirect suction method that the suction force generated according to the operation of the fan 7C is consecutively transmitted from the exhaust duct 7B, drum 3, suction duct 7A and heater 6. Accordingly, in case suction resistance is large, that is, in case a large amount of clothes are dried or much lint of clothes exists at the filter, suction efficiency of the heated air is decreased. Therefore, clothes drying efficiency is decreased or time for drying is increased.

Also, since the air is flown only by the suction force of a fan 7C in the air circulation process in such conventional clothes dryer, load of the driving motor 4 for driving the fan 7C increases, thus to cause often breakdowns.

SUMMARY OF THE INVENTION

Therefore, the present invention provides a clothes dryer capable of improving clothes drying performance and reduce time for drying clothes by increasing the amount of air supplied into a drum to solve the above problem.

To achieve these and other advantages and in accordance with the purpose of the present invention, as embodied and broadly described herein, there is provided a clothes dryer including a drum supported in a case rotatably, for drying clothes inserted to the inside of the case, a driving means installed in the case, for rotating the drum, a suction duct connected to a side of the drum, for supplying heated air to the inside of the drum, an exhaust duct connected to the another side of the drum, for exhausting air which dried the clothes in the drum, a first blowing means installed in the suction duct or the exhaust duct, for providing air into the drum and exhausting the air at the same time and a suction increasing means installed in the case, for blowing air into an inlet of the suction duct.

A heater for heating air supplied into the drum is installed at the inlet of the suction duct and the suction increasing means exhausts air to the inlet portion.

In accordance with an embodiment of the present invention, the suction increasing means includes a suction increasing duct having an exhaust port positioned at the inlet side of the suction duct and a second blowing means installed in the suction increasing duct, for generating a blowing force.

The first blowing means and the second blowing means generate a blowing force by a power of the driving means. The first blowing means and the second blowing means are composed of a double inlet fan combined to a driving shaft at a side of the driving means as a single body and the double inlet fan is installed positioning the first blowing unit in the exhaust duct and the second blowing unit in the suction increasing duct respectively.

A blocking means for blocking flowing of air between the exhaust duct and suction increasing duct is positioned between the first blowing means and the second blowing means and the first blowing portion is formed larger than the second blowing portion positioned in the suction increasing duct.

In accordance with an embodiment of the present invention, the first blowing means and the second blowing means are fans respectively combined to the double driving shafts of the driving means to generate a blowing force by respective driving means.

In accordance with other embodiment of the present invention, the first blowing means and the suction increasing means are respectively combined to the double driving shafts of the driving means and generate a blowing force and the suction increasing means is an axial flow fan installed at the front of the suction duct.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
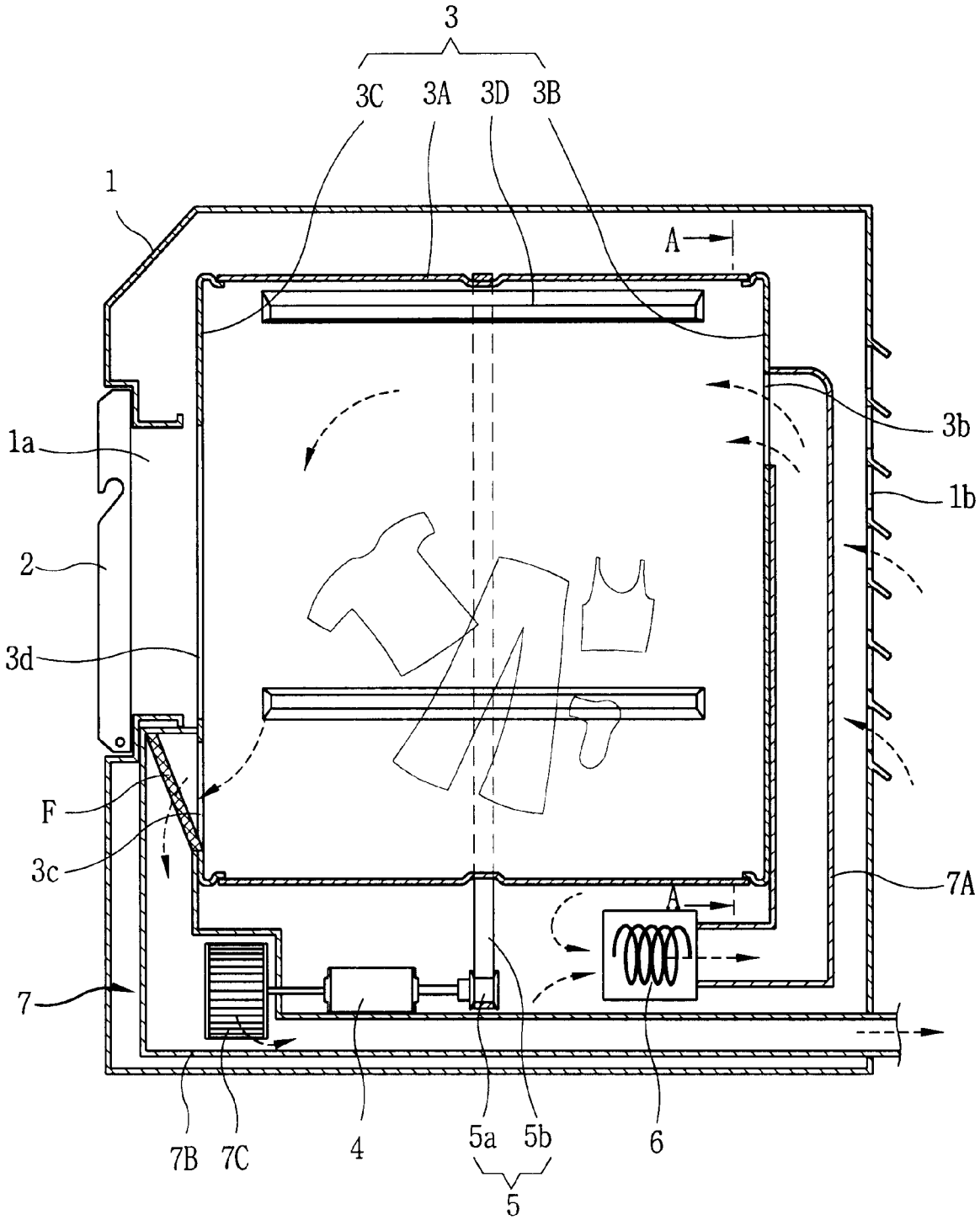
FIG. 1 CONVENTIONAL ART
FIG. 1 is a longitudinal sectional view showing an example of a conventional clothes dryer.
Figure 2:
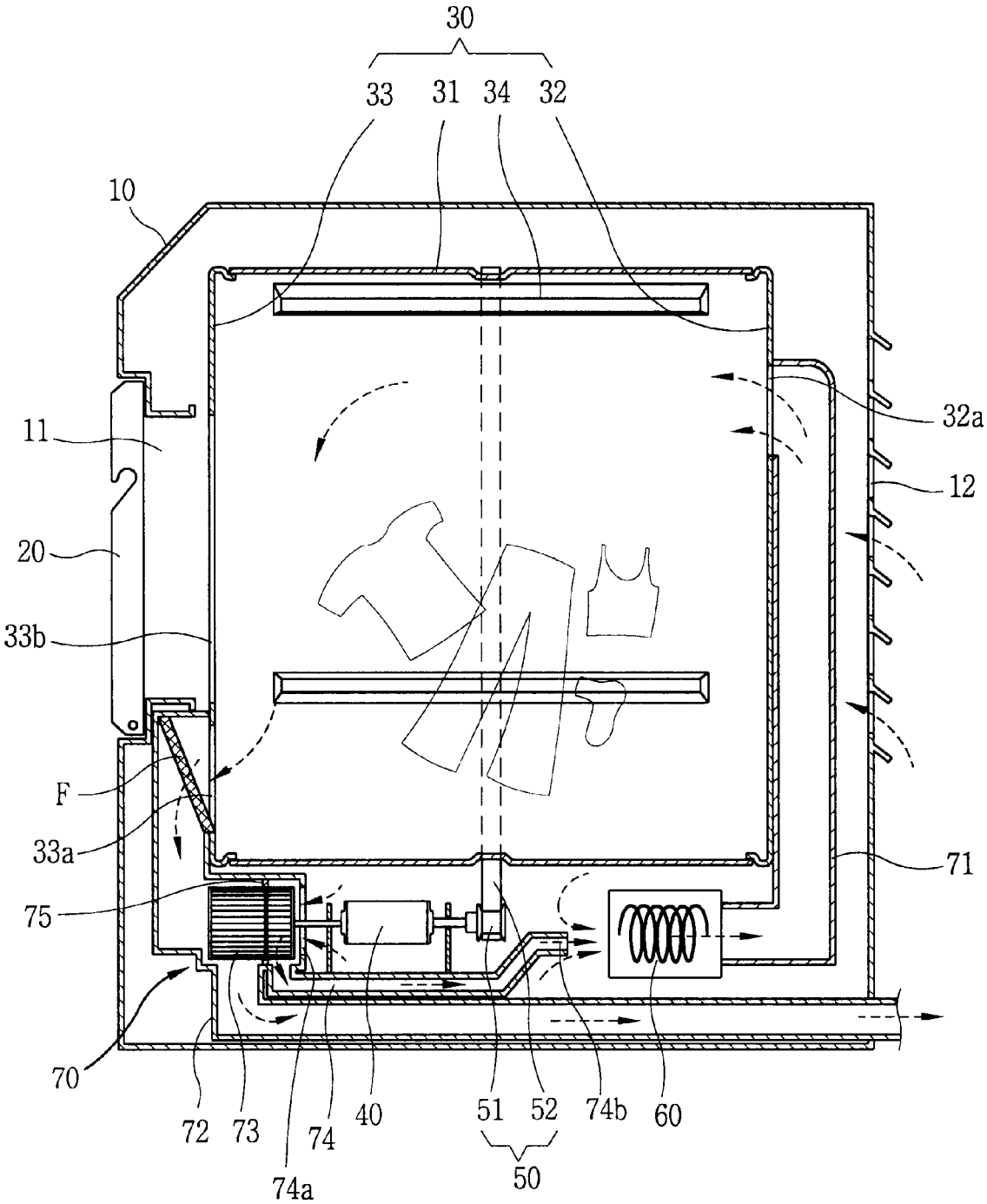
FIG. 2 is a longitudinal sectional view showing a clothes dryer in accordance with a first embodiment of the present invention.
Figure 3:
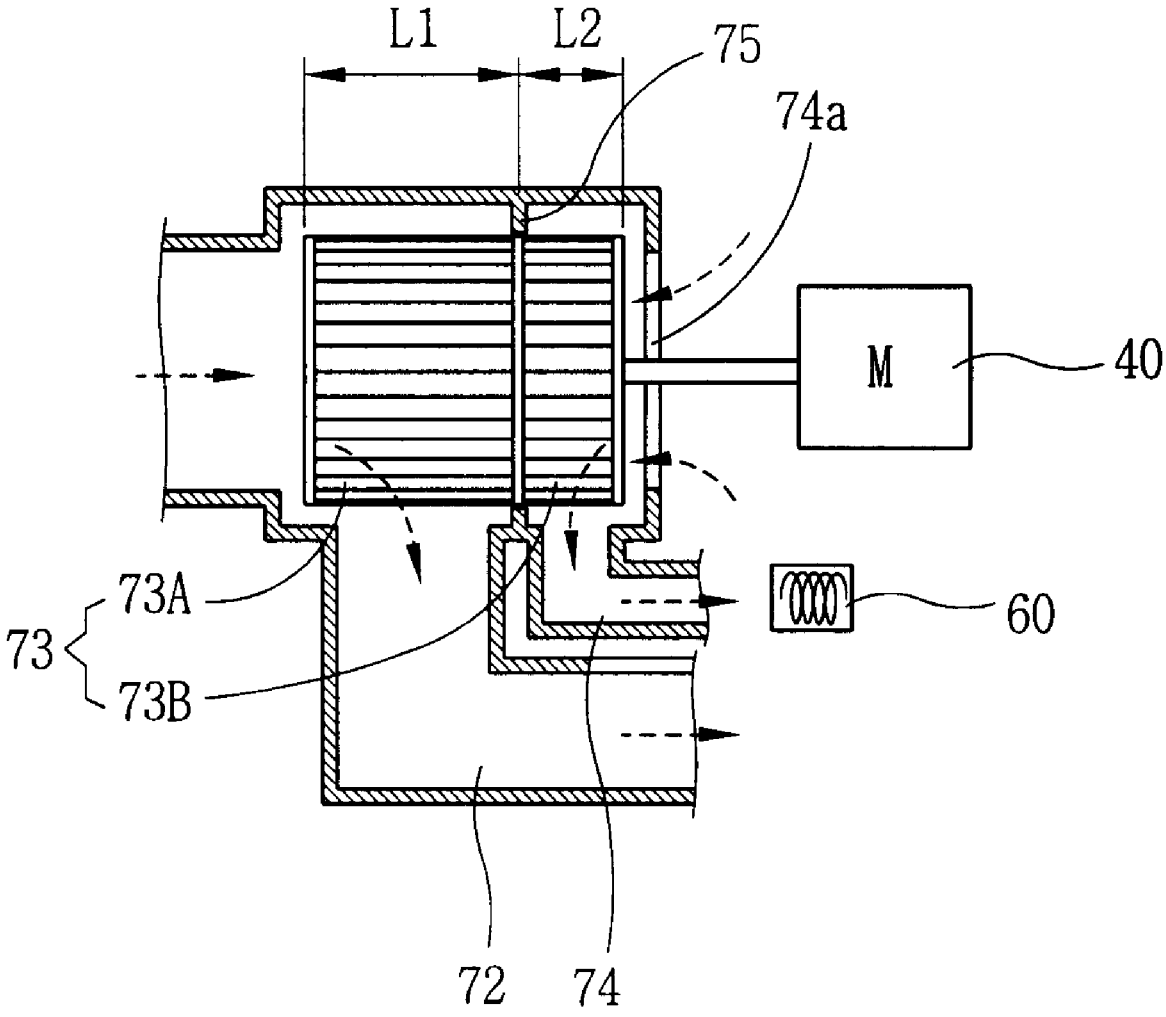
FIG. 3 is a detail view showing a blowing structure of the clothes dryer shown in FIG. 2.

FIG. 2 is a longitudinal sectional view showing a clothes dryer in accordance with the first embodiment of the present invention and FIG. 3 is a detail view showing a double blowing structure of the clothes dryer shown in accordance with the first embodiment of the present invention.

With reference to FIG. 2, the clothes dryer in accordance with the first embodiment of the present invention includes a case 10 having an input opening 11 on the front surface and an air inflow holes 12 on the rear surface, a door 20 for opening and closing the input opening 11 of the case 10, a drum 30 installed in the case 10 rotatably, for receiving clothes, having a plurality of baffles 34 protruded on the inner circumferential surface, a driving motor 40 positioned in the case 10, for generating a rotation force, a transmission means 50 for transmitting the rotation force of the driving motor 40 to the drum 30, an air circulation unit 70 for sucking the external air of the case 10 into the drum 3 and exhausting the air which dried clothes in the drum 30 into the outside of the case 10 and a heater 60 installed at the inlet side of the air circulation unit 70, for heating air flown into the drum.

The drum 30 includes a body having a cylindrical shape, rotating being connected to the driving motor 40 and the transmission means 50 and a rear plate 32 and a front plate 33 combined to both side surfaces of the body 31 capable of performing relative movement.

On the rear plate 32 and the front plate 33, a suction port 32A connected with a suction duct 71 which will be described later and an exhaust port 33A connected with an exhaust duct 72 are formed.

The driving motor 40 is a one-direction rotating motor which rotates in the same direction and at same speed, having driving shafts led in the both directions. A driving shaft is combined with the transmission means 50 for rotating the drum 30 and the other driving shaft is combined with a fan 73 of the air circulation unit 70.

The transmission means 50 includes a pulley 51 combined with the driving shaft at a side of the driving motor 40 and a belt 52 connected from the pulley 51 to the body 31 of the drum 30, for transmit the rotation force of the driving motor 40 to the body 31.

The heater 60 is formed as an electric heater or gas heater and installed at the inlet side of the suction duct.

The air circulation unit 70 includes the suction duct 71 to flow the air flown through the inlet port 12 of the case 10 into the drum, the exhaust duct 72 connected to exhaust the air in the drum 30 to the outside, a suction increasing duct 74 installed on a side surface of the exhaust duct 72, for compulsorily supplying air from the inside of the case 10 to the inlet side of the heater 60 and a double inlet fan 73 installed at the center of the exhaust duct 72 and the suction increasing duct 74, for sucking and exhausting the air to the both directions.

The inlet portion of the suction duct 71 is positioned at the rear of the heater and the outlet portion is installed connected to the suction port 32A of the drum 30.

The exhaust duct 72 is connected to the exhaust port 33A of the drum 30 and is expanded-installed to the outside of the case 10.

The suction increasing duct 74 has an inlet port 74A formed at the portion where the driving shaft of the driving motor 40 is connected and an exhaust port 74B positioned at the inlet side of the heater 60.

With reference to FIG. 3, the double inlet fan 73 is composed of the first blowing portion 73A and the second blowing portion 73B which are respectively positioned at the exhaust duct 72 and the suction increasing duct 74 as a single body and a blocking film 75 is installed between the exhaust duct 72 and the suction increasing duct 74 to separate the first blowing portion 73A and the blowing portion 73B.

It is desirable that the fan length L1 of the first blowing portion 73A is larger than the fan length L2 of the second blowing portion 73B in the double suction inlet fan 73. Here, it is desirable that the size of the second blowing portion 73B does not exceed 30% of the size of the first blowing portion 73A.

In FIG. 2, reference numeral 33*b* designates an input opening of the drum 30 and F designates a filter for refining air discharged from the drum 30.

The operation of the clothes dryer in accordance with the first embodiment of the present invention will be described as follows.

When a power is applied to the driving motor 40, the drum 30 rotates. At this time, clothes inputted into the drum 30 are mixed and flown. At the same time, as the double inlet fan 73 rotates, air at the outside of the case 10 is heated by the heater 60 after being flown to the inside and the heated air is flown into the drum 30 through the suction duct 71 and dries the clothes.

The air which dried the clothes in the drum 30 is exhausted to the outside of the case 10 through the exhaust port 33*a* and exhaust duct 72.

Particularly, the first blowing portion 73A and the second blowing portion 73B rotate as a single body by a driving force of the driving motor 40 in the double inlet fan 73.

Here, the first blowing portion 73A has the exhaust duct 72 and drum 30 generate a suction force at the suction duct 71 and exhaust air which dried the clothes in the drum 30 to the outside of the case 10 through the exhaust duct 72.

The second blowing portion 73B sucks the air flown into the case 10 and it pressurizes and pushes the air flown into the suction duct 71 through the heater 60 by supplying the air exhausting to the front side of the heater 60.

Therefore, as the amount of the air flown to the suction duct 71, the amount of the supplied air compared with the same load of the driving motor 40 is increased and accordingly, drying performance can be improved.

Also, time for drying clothes compared with the same amount of clothes is reduced and increase of load of the driving motor 60 is prevented even if the amount of clothes is increased, thus to reduce breakdowns of the clothes dryer caused by the driving motor 60.

Figure 4:
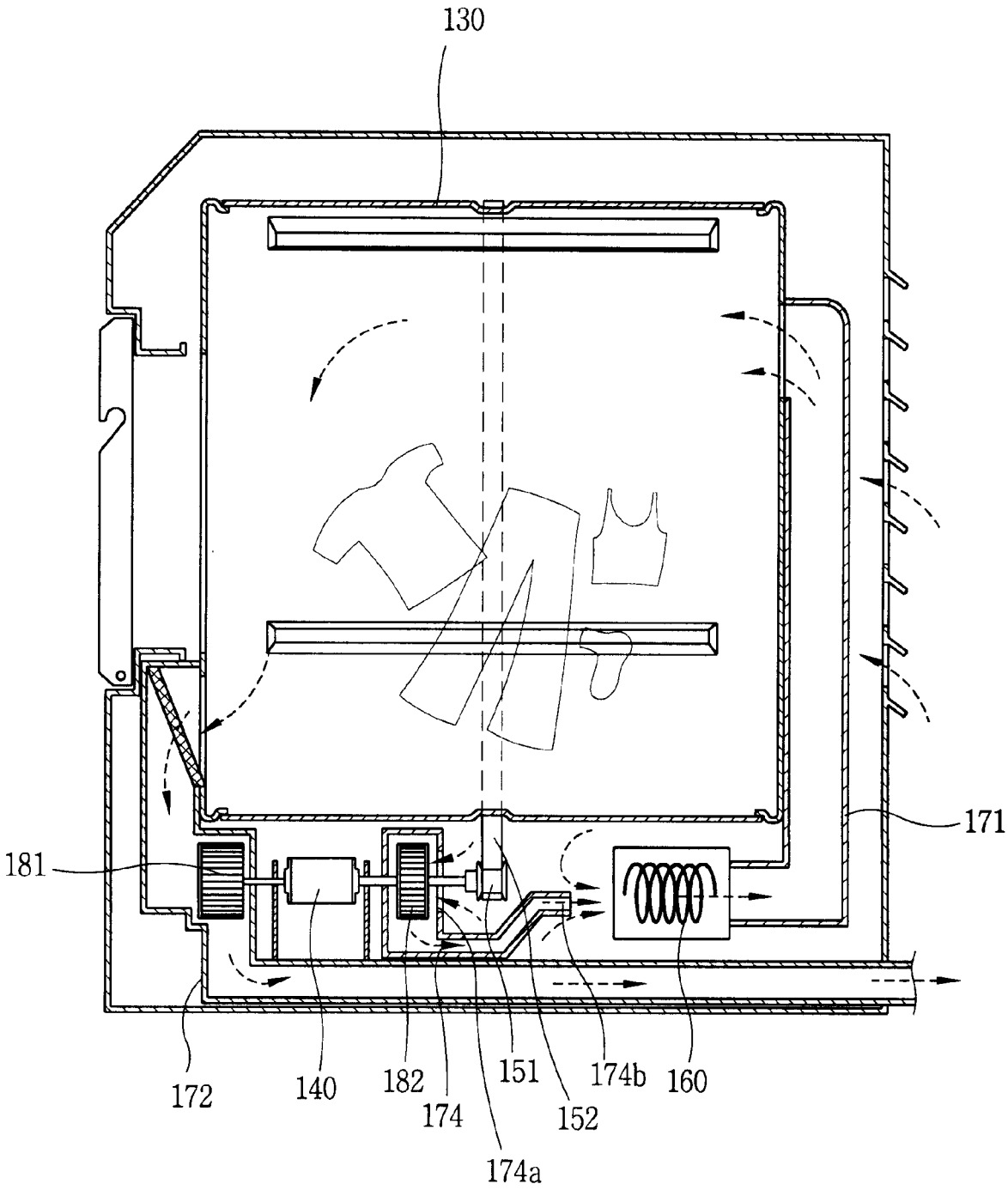
FIG. 4 is a longitudinal sectional view showing a clothes dryer in accordance with a second embodiment of the present invention.

FIG. 4 is a longitudinal sectional view showing the clothes dryer in accordance with a second embodiment of the present invention.

In the clothes dryer in accordance with a second embodiment of the present invention, an exhaust duct 172 and a suction increasing duct 174 are separated-installed at the both sides centering around a driving motor 140 and a first fan 181 and a second fan 182 are respectively positioned at the exhaust duct 172 and suction increasing duct 174.

Here, the first fan 181 and a second fan 182 rotate respectively connected to the both driving shafts of the driving motor 140 and accordingly generate a blowing force at the exhaust duct 172 and the suction increasing duct 174.

The driving shaft connected to the second fan 182 penetrates the suction increasing duct 174, being lengthened and a pulley 151 is fixed to the end to rotate a drum 130 by transmitting the driving force to a belt 152.

In the suction increasing duct 174, a suction port 174*a* is formed at a side and an exhaust port 174*b* is positioned at the front of a heater 160 to supply air into a suction duct 171.

Since another components except main components described above are same as the composition of the first embodiment of the present invention in such clothes dryer in accordance with the second embodiment of the present invention, the description will be omitted.

Figure 5:
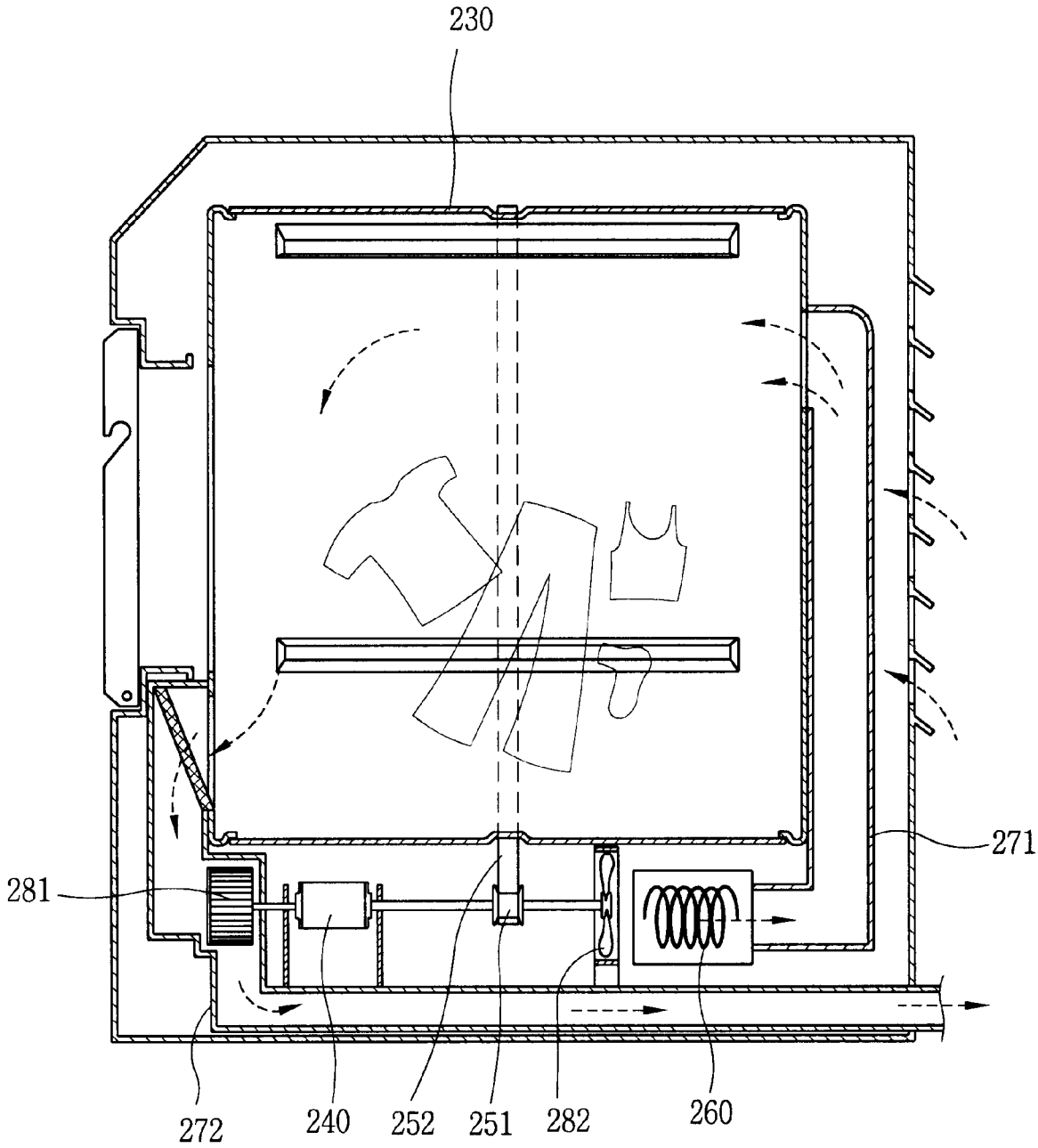
FIG. 5 is a longitudinal sectional view showing a clothes dryer in accordance with a third embodiment of the present invention.

FIG. 5 is a longitudinal sectional view showing the clothes dryer in accordance with a third embodiment of the present invention.

In the first and second embodiments of the present invention, a suction increasing duct is positioned and a centrifugal fan is installed in the suction increasing duct to exhaust air to the inlet of the heater. On the other hand, in the third embodiment of the present invention, an axial flow fan 282 is installed at the right front of a heater 260 to exhaust air to a suction duct 271.

Namely, the centrifugal fan 281 is installed in an exhaust duct 272 combined to a shaft of a driving motor 240 and the axial flow fan 282 rotates at the right front of the heater 260 combined to the other shaft of the driving motor 240.

A pulley 251 connected with a belt 252 is installed at a shaft of the driving motor 240 where the axial flow fan 282 is installed to rotate a drum 230.

On the other hand, in the first, second and third embodiments of the present invention, two fans are installed in a driving motor to be rotary driven but a plurality of driving motors can be installed to respectively drive the two fans.

Since the clothes dryer in accordance with the present invention compulsorily supplies air to the front of the suction duct and heater to increase the amount of air flown to the drum, drying performance can be improved by reducing initial heating time of the air flown to the drum and increasing the amount of circulating air.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A clothes dryer, comprising:

a drum rotatably supported in a case, for drying clothes inserted into the case;

driving means installed in the case, for rotating the drum;

a suction duct connected to a side of the drum, for supplying heated air into the drum;

an exhaust duct connected to another side of the drum, for exhausting the supplied heated air used for drying clothes in the drum;

first blowing means installed in the suction duct or the exhaust duct, for simultaneously providing air into the drum and also exhausting the air therefrom; and suction increasing means installed in the case, for blowing air towards an inlet of the suction duct, said suction increasing means comprising a suction increasing duct having a second blowing means installed for generating a blowing force and an inlet port positioned at said second blowing means and an exhaust port positioned proximate to a heater which is supplied air from said suction increasing duct and from the drum.

2. The dryer of claim 1, wherein the heater for heating air supplied into the drum is installed at the inlet of the suction duct and the suction increasing means exhausts air through the inlet portion of the heater.

3. The dryer of claim 1, wherein the first blowing means and the second blowing means generate a blowing force by a power of the driving means.

4. The dryer of claim 3, wherein the first blowing means and the second blowing means are composed of a double inlet fan combined to a driving shaft at a side of the driving means as a single body, and the double inlet fan is installed to position a first blowing portion in the exhaust duct and a second blowing portion in the suction increasing duct respectively.

5. The dryer of claim 4 wherein the first blowing portion formed in the exhaust duct is larger than the second blowing portion formed in the suction increasing duct.

6. The dryer of claim 1, wherein the first blowing means and the second blowing means generate a blowing force by respective driving means.

7. The dryer of claim 1, wherein the first blowing means and the second blowing means are fans respectively connected to each end of the driving shaft of the driving means to generate a blowing force.

8. The dryer of claim 7, wherein a heater for heating air supplied into the drum is installed at the inlet of the suction duct, and the suction increasing duct is formed to exhaust air into the inlet portion of the heater.

9. The dryer of claim 1, wherein the first blowing means and the suction increasing means are connected to respective ends of a driving shaft of the driving means to generate a blowing force and the suction increasing means is an axial flow fan installed, at a front of the suction duct.

10. A clothes dryer, comprising:

a drum rotatably supported in a case, for drying clothes inserted into the case;

driving means installed in the case, for rotating the drum; a suction duct connected to a side of the drum, for supplying heated air into the drum;

a heater installed at an inlet side of the suction duct, for heating the air supplied into the drum;

an exhaust duct connected to another side of the drum, for exhausting the supplied heated air used for drying clothes in the drum;

first blowing means installed in the suction duct or the exhaust duct, for simultaneously providing air into the drum and also exhausting the air therefrom; and suction increasing means installed in the case, for blowing air towards an inlet side of the heater, said suction increasing means comprising a suction increasing duct having a second blowing means installed for generating a blowing force and an inlet port positioned at said second blowing means and an exhaust port positioned proximate to a heater which is supplied air from said suction increasing duct and from the drum, for generating a blowing force.

11. The dryer of claim 10, wherein the first blowing means and the second blowing means are composed to generate the blowing force by a power of the driving means.

12. The dryer of claim 11, wherein the first blowing means and the second blowing means double inlet fan connected to a driving shaft of the driving means as a single body, and the double inlet fan is installed to position a first blowing portion and a second blowing portion respectively in the exhaust duct and the suction increasing duct.

13. The dryer of claim 12, wherein the first blowing portion positioned in the exhaust duct is formed larger than the second blowing portion positioned in the suction increasing duct.

14. The dryer of claim 10, wherein the first blowing means and the second blowing means are fans respectively connected to each end of the driving shaft of the driving means to generate a blowing force by a power of the driving means.

15. The dryer of claim 11, wherein the first blowing means and the suction increasing means are respectively connected to each end of the driving shaft of the driving means, and generate a blowing force and the suction increasing means is an axial flow fan installed at the front of the heater.

16. A clothes dryer, comprising:

a drum rotatably supported in a case, for drying clothes inserted into the case;

driving means installed in the case, for rotating the drum;

a suction duct connected to a side of the drum, for supplying heated air into the drum;

an exhaust duct connected to another side of the drum, for exhausting the supplied heated air used for drying clothes in the drum;

first blowing means installed in the suction duct or the exhaust duct, for simultaneously providing air into the drum and also exhausting the air therefrom;

suction increasing means installed in the case, for blowing air towards an inlet of the suction duct, said suction increasing means comprising a suction increasing duct having an exhaust port positioned at the inlet side of the suction duct, and second blowing means installed in the suction increasing duct, for generating a blowing force, said blowing force being generated by said first blowing means and said second blowing means, said first blowing means and said second blowing means being composed of a double inlet fan combined to a driving shaft at a side of the driving means as a single body, and the double inlet fan being installed to position a first blowing portion in the exhaust duct and a second blowing portion in the suction increasing duct, respectively, and blocking means for blocking a flow of air between the exhaust duct and the suction increasing duct positioned between the first blowing means and the second blowing means.

17. A clothes dryer, comprising:

a drum rotatably supported in a case, for drying clothes inserted into the case;

driving means installed in the case, for rotating the drum;

a suction duct connected to a side of the drum, for supplying heated air into the drum;

a heater installed at an inlet side of the suction duct, for heating the air supplied into the drum;

an exhaust duct connected to another side of the drum, for exhausting the supplied heated air used for drying clothes in the drum;

first blowing means installed in the suction duct or the exhaust duct, for simultaneously providing air into the drum and also exhausting the air therefrom; and suction increasing means installed in the case, for blowing air towards an inlet side of the heater, said suction increasing means comprising a suction increasing duct having an exhaust port positioned at the inlet side of the heater, and second blowing means installed in the suction increasing duct, for generating a blowing force, said blowing force being generated by said first blowing means and said second blowing means, the first blowing means and the second blowing means are composed of a double inlet fan connected to a driving shaft of the driving means as a single body, and the double inlet fan is installed to position a first blowing portion and a second blowing portion respectively in the exhaust duct and the suction increasing duct; and blocking means for blocking a flow of air between the exhaust duct and the suction increasing duct is positioned between the first blowing portion and the second blowing portion.

* * * * *